US006940215B2

(12) United States Patent
Park

(10) Patent No.: US 6,940,215 B2
(45) Date of Patent: Sep. 6, 2005

(54) CATHODE RAY TUBE

(75) Inventor: Sang Yoon Park, Gyeongsangbook-do (KR)

(73) Assignee: LG. Philips Displays Korea Co., Ltd., Gumi-si (KR)

( * ) Notice: Subject to any disclaimer, the term of this patent is extended or adjusted under 35 U.S.C. 154(b) by 182 days.

(21) Appl. No.: 10/461,452

(22) Filed: Jun. 16, 2003

(65) Prior Publication Data

US 2004/0066131 A1 Apr. 8, 2004

(30) Foreign Application Priority Data

Oct. 8, 2002 (KR) ..... 10-2002-0061228

(51) Int. Cl.[7] ..... H01J 31/00
(52) U.S. Cl. ..... 313/477 R; 313/440; 220/2.1 A

(58) Field of Search ..... 313/477 R, 440; 220/2.1 A

(56) References Cited

U.S. PATENT DOCUMENTS 5,929,559 A 7/1999 Sano et al.
6,002,203 A 12/1999 Yokota et al.

FOREIGN PATENT DOCUMENTS

KR 1998-025183 A 7/1998

*Primary Examiner*—Mariceli Santiago
*Assistant Examiner*—Anthony Perry
(74) *Attorney, Agent, or Firm*—Birch, Stewart, Kolasch & Birch, LLP

(57) ABSTRACT

The present invention relates to a cathode ray tube, and more particularly, to a funnel for CRT to increase the BSN neck shadow margin by changing the shape of the yoke portion.

34 Claims, 11 Drawing Sheets

(a)

(b)

(a)

(b)

CATHODE RAY TUBE

BACKGROUND OF THE INVENTION

1. Field of the Invention

The present invention relates to a cathode ray tube (CRT), and more particularly, to a funnel for a CRT to increase the BSN neck shadow margin by changing the shape of a yoke portion.

2. Description of the Related Art

FIG. 1 illustrates the configuration of a flat color cathode ray tube according to the related art.

Referring to FIG. 1, the flat color cathode ray tube is a kind of vacuum tube that includes a panel 1 which is a front glass and a funnel 2 which is a rear glass sealingly coupled with the panel 1 so that the flat color cathode ray tube is vacuum inside.

A fluorescent screen 4 is formed inside the panel 1. An electron gun 13 is installed at a neck portion of the funnel 2 opposed to the fluorescent screen 4.

A shadow mask 7 is installed between the fluorescent screen 4 and the electron gun 13, spaced by a predetermined distance from the fluorescent screen 4 to select colors. The shadow mask 7 is coupled with a mask frame 3, elastically supported by a mask spring 8 and supported on the panel 1 by a stud pin 12.

In addition, the mask frame 3 is coupled with a magnetic inner shield 9 to reduce the effect of the earth magnetic field in the rear of the cathode ray tube so that the movement of electron beam 6 caused by external magnetic field is reduced.

Meanwhile, a convergence purity correction magnet (CPM) 10 is installed at a neck portion of the funnel 2 to control an RGB electron beam so that an electron beam 6 emitted from an electron gun 13 is converged on one spot. The neck portion of the funnel 2 is provided with a deflection yoke 5 to deflect the electron beam and reinforcement band 11 to strengthen the front glass against internal vacuum.

The operation of the flat color cathode ray tube configured as described above will be described. The electron beam 6 emitted from the electron gun 13 is deflected in vertical and horizontal directions by the deflection yoke 5. The deflected electron beam 6 passes a beam passage hole of a shadow mask 7 and collides a front fluorescent screen 4 to display a predetermined desired color image.

For such a color cathode ray tube, consuming power is critical problem. So, the method of reducing the consuming power of the deflection yoke 5 has been studied.

Due to those studies, it has been developed that the outer diameter of a funnel yoke installation part on which a deflection yoke is installed is made to be small to reduce the space of deflection magnetic field so that the deflection field affects the electron beam efficiently.

However, if the outer diameter of the funnel yoke installation part is made only small, the electron beam deflected by the deflection yoke 5 collides the inner wall near to the neck of the funnel 2 to make the area A on the fluorescent screen 4 which the electron bean does not reach.

Accordingly, the conventional cathode ray tube is limited to reduce the outer diameter of the funnel yoke installation part.

In order to overcome this problem, in Japanese Laid-Open Patent publication No. 48-34349, it is described that the cross-sectional shape of the funnel is made to vary from circle to almost rectangle via ellipse as it goes from the neck portion to the funnel since the passage area along with a locus of the electron beam passing the yoke installation part in vicinity of the neck of the funnel is almost rectangular when drawing a raster that has a rectangular shape on the fluorescent screen.

In other words, referring to the cross-sectional shapes of in directions a—a, b—b, c—c, d—d and e—e of the funnel 1 and the funnel yoke installation part 14, it is found that the cross-sectional shape varies from circle to almost rectangle via ellipse as it travels from the neck portion to the funnel 1.

Accordingly, the deflection yoke has its cross-sectional shape is rectangular due to the shape of the yoke installation part of the funnel.

FIGS. 5*a* and 5*b* illustrate a deflection yoke that has rectangular cross-sectional shape.

Referring to FIGS. 5*a* and 5*b*, a deflection yoke includes a pair of horizontal deflection coils 21 for deflecting an electron beam emitted from an electron gun 13 in a horizontal direction, a pair of vertical deflection coils 22 for deflecting an electron beam emitted from an electron gun 13 in a vertical direction, a conical ferrite core 24 for reducing a loss of magnetic force generated by current passing through the horizontal deflection coils 21 and the vertical deflection coils 22 to enhance the efficiency of deflection, a holder 23 coupled directly with a neck portion of the funnel 2, a comma free coil 25 installed at the rear of the holder 23, for improving comma aperture, a ring band 25 installed at the rear of the holder 23, for coupling the funnel 2 with the deflection yoke 5 and a magnet 27 installed at outer side of an opening of the holder 23, for correcting raster distortion of screen.

The operation of the conventional deflection yoke 5 configured as described above will be described. The horizontal deflection coil 21 is provided with current that has a frequency of 15.75 KHz or more and deflects an electron beam in a horizontal direction using the magnetic field generated by the current. The vertical deflection coil 22 is provided with current that has a frequency of 60 Hz and deflects an electron beam in a vertical direction using the magnetic field generated by the current.

Generally, self-convergence method is employed to deflect electron beams by using non-uniform magnetic field to converge the electron beams-on a screen without any additional circuits or devices for each of three electron beams. The self-convergence method is the method to control the distribution of wires wound on the horizontal and vertical coils 21 and 22 and generate barrel or pin cushion magnetic field for each of the front portion, the middle portion and the rear portion of the deflection yoke 5 so that different deflection forces are applied to three electron beams 6 according to their locations to converge the electron beams 6 on the same point.

It is difficult that electron beams are deflected to the desired position by only the magnetic fields of the horizontal and vertical deflection coils 21 and 22. To compensate for this, a ferrite core 24 that has high permeability is used to minimize a loss of feedback path of the magnetic field to maximize the magnetic force.

FIGS. 6*a* and 6*b* illustrates combination of a funnel and a deflection yoke the cross-section of which is rectangle-shaped.

Referring to FIGS. 6*a* and 6*b*, in the configuration of the deflection yoke 5 as shown in FIG. 5*a,* 7n % or more of the deflection coils are distributed on a shorter side and a diagonal location of the deflection yoke 5, and misconvergence correction ferrite sheet is attached to the upper portion of the deflection coils.

Accordingly, as shown in FIGS. 6*a* and 6*b*, referring to a diagram illustrating coupling of the deflection yoke 5 and a yoke installation part 14 formed at the funnel 2, the couple gap (FIG. 6*b*) between the shorter side (vertical side) of the deflection yoke 5 and the yoke installation part 14 is formed to be bigger than the couple gap (FIG. 6*a*) between the longer side (horizontal side) of the deflection yoke 5 and the yoke installation part 14.

The horizontal deflection coil 2 and a ferrite sheet are coupled in a gap between the shorter side of the deflection yoke 5 and the yoke installation part 14.

FIG. 7 is a perspective view of a yoke installation part coupled with a deflection yoke the cross-section of which is rectangular-shaped according to the related art.

Referring to FIG. 7, since the cross-section of the deflection yoke is rectangle-shaped, the cross-section of the yoke installation 14 of the funnel 2 is also rectangle-shaped.

As described above, since the cross-section of the deflection yoke is rectangle-shaped, the deflection sensitivity is improved and the consuming power is lowered. However, since the deflection sensitivity is improved and the movement of the electron beam gets very sensitive to the deflection yoke control, it causes a beam strike neck (BSN) phenomenon in which electron beam collides an inner wall of the yoke installation part 14 of the funnel so that the electron beam cannot reach a fluorescent screen.

When controlling yoke pull back (YPB) in installing a deflection yoke, the electron beam collides the yoke installation part to cause the BSN phenomenon in case that the deflection yoke is shifted to the neck of the funnel to optimize YPB.

To overcome this problem and ensure BNS neck shadow margin (NSM), employed are the method of shifting a deflection center of the deflection yoke to a tube axis and the method of enlarging the cross-sectional area perpendicular to the direction of the tube axis of the yoke installation part of the funnel to prevent the electron beam from colliding the funnel. However, these methods causes the side effect to deteriorate the deflection sensitivity of the deflection yoke and cause the deflection yoke to require more consuming power.

Accordingly, mainly used is the method of making the thickness of the portion of the funnel to be thin, which is collided by the electron beam. However, it lowers the productivity of the funnel to make the funnel thin, which is formed to have the minimal thickness.

In addition, it is disclosed in Korean Laid-Open Patent Publication No. 1998-25183 that the outer surface of the cross-section of the yoke installation part perpendicular to the direction of the tube axis is formed to non-circle-shaped and the inner surface of the cross-section is formed to be convex curved surface protruded toward the tube axis so that the vacuum exterior vessel is so strong to resist air pressure and the power for deflection is lowered. However, it has no effect to gain the BSN neck shadow margin.

SUMMARY OF THE INVENTION

Accordingly, the present invention is directed to a cathode ray tube that substantially obviates one or more problems due to limitations and disadvantages of the related art.

An object of the present invention is to enhance the close contactness between the funnel and the deflection yoke without decreasing the productivity of the funnel, weakening the deflection sensitivity and increasing the power consumption so that although the deflection yoke is moved toward the neck of the funnel, the electron beams do not strike the yoke installation part to enhance the BSN neck shadow margin and the deflection efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a cathode ray tube including: a panel being a front glass; a funnel coupled with the panel to maintain vacuum inside; a fluorescent screen formed inside the panel; a shadow mask spaced by a predetermined gap from the fluorescent screen, for selecting colors; an electron gun installed at a neck of the funnel; and a deflection yoke for deflecting an electron beam emitted from the electron gun in horizontal and vertical directions, wherein the funnel at which the deflection yoke is installed is provided with a yoke installation part, and an outer surface of a shorter side of a cross-section perpendicular to a tube axis of the yoke installation part is protruded toward the tube axis, and has a maximal protruded distance of 1.5 mm or less.

In another aspect of the present invention, there is provided a cathode ray tube including: a panel being a front glass; a funnel coupled with the panel to maintain vacuum inside; a fluorescent screen formed inside the panel; a shadow mask spaced by a predetermined gap from the fluorescent screen, for selecting colors; an electron gun installed at a neck portion of the funnel; and a deflection yoke for deflecting an electron beam emitted from the electron gun in horizontal and vertical directions, wherein the funnel at which the deflection yoke is installed is provided with a yoke installation part, the funnel has a cross-section of which inner shape or outer shape vary from a circle to a non-circle as it goes from the neck to the panel, and an outer surface of a shorter side of a cross-section perpendicular to a tube axis of the yoke installation part is protruded to the tube axis and has a maximal protruded distance of 1.5 mm or less.

In another aspect of the present invention, there is provided a cathode ray tube including: a panel being a front glass; a funnel coupled with the panel to maintain vacuum inside; a fluorescent screen formed inside the panel; a shadow mask spaced by a predetermined gap from the fluorescent screen, for selecting colors; an electron gun installed at a neck portion of the funnel; and a deflection yoke for deflecting an electron beam emitted from the electron gun in horizontal and vertical directions, wherein the funnel at which the deflection yoke is installed is provided with a yoke installation part, and an outer surface of a shorter side of a cross-section perpendicular to a tube axis of the yoke installation part forms a curvature protruded toward the tube axis and has a maximal vertical curvature radius (Rv) of 1900 mm or less.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Table 1 illustrates the thickness of the yoke installation part of a general funnel for cathode ray tube.

TABLE 1

| Location (mm) | Thickness of longer side (mm) | Thickness of shorter side (mm) | Thickness of diagonal side (mm) |
|---|---|---|---|
| +35 | 4.55 | 4.65 | 3.23 |
| +30 | 4.03 | 3.93 | 2.91 |
| +25 | 3.75 | 3.75 | 2.63 |
| +20 | 3.58 | 3.60 | 2.49 |
| +15 | 3.48 | 3.53 | 2.38 |
| +10 | 3.35 | 3.43 | 2.35 |
| +5 | 3.25 | 3.30 | 2.36 |
| Reference line (RL) | 3.05 | 3.10 | 2.36 |
| −5 | 2.85 | 2.85 | 2.30 |

TABLE 1-continued

| Location (mm) | Thickness of longer side (mm) | Thickness of shorter side (mm) | Thickness of diagonal side (mm) |
|---|---|---|---|
| −10 | 2.68 | 2.63 | 2.35 |
| −15 | 2.60 | 2.63 | 2.45 |
| −20 | 2.58 | 2.63 | 2.59 |
| −25 | 2.55 | 2.73 | 2.78 |
| −30 | 2.78 | 2.78 | 2.81 |

As shown in table 1, the thickness of the funnel in the direction (+) to the funnel is different from the thickness of the funnel in the direction (−) to a neck. Especially, the diagonal side is formed thinner than any other sides and the shorter side is formed thicker than any other sides, based on the reference line (RL) corresponding to an approximate deflection center.

Accordingly, in order to enhance the close contactness and enhance sealing adhesion and gain BNS neck shadow margin in the cathode ray tube according to the present invention, it is possible to form the thickness of a shorter side of a yoke installation part of a funnel thinly by making an outer curvature of the shorter side of the yoke installation part of the funnel to protrude toward a tube axis and be convex.

Figure 8:
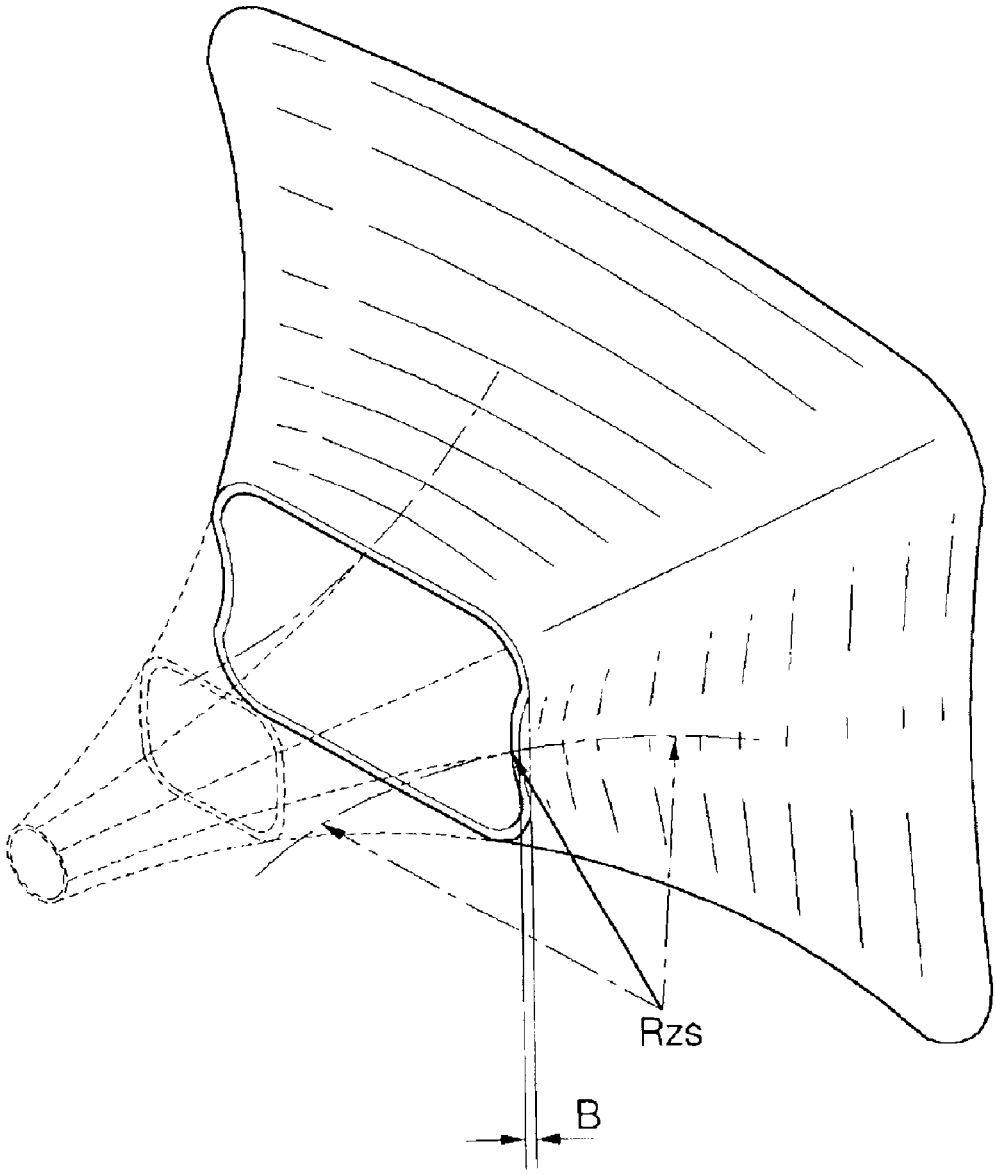
FIG. 8 illustrates a funnel for a cathode ray tube according to the present invention.

FIG. 8 illustrates a funnel for a cathode ray tube according to the present invention.

FIG. 8 is a cross-sectional view of a yoke installation part of a funnel. Referring to FIG. 8, the outer surface of a shorter side of a cross-section perpendicular to a direction of a tube axis is protruded to a tube axis at the yoke installation part of the funnel.

If the maximal length between a starting point and a terminal point of the protruded convex portion is B, it is desired that the distance is 1.5 mm or less.

In general, a ferrite sheet is 0.3 mm~0.5 mm thick and a tape for fixing the ferrite sheet is 0.2 mm thick or less.

Accordingly, even though two ferrite sheets are adhered to the same position, the length is not longer than 1.5 mm and the length of B is 1.5 mm or less so that the close contactness between the funnel and the deflection yoke can be increased.

More desirably, when the maximal length B between the starting point and the terminal point of a protruded convex portion is ranged from 0.3 mm to 1.0 mm, a supporting member such as a ferrite sheet is easy to insert and concentration of stress is small.

In addition, it is desired that the funnel be made to have a cross-section of which inner surface shape and outer surface shape are changed from a circle to a non-circle as it goes from the neck of the funnel to the panel so that the outer diameter of the yoke installation part is made small to enhance the deflection efficiency.

Referring to FIG. 8, in the yoke installation part of the funnel, the inner surface of a shorter side of a cross-section perpendicular to a tube axis forms a curvature protruded toward the tube axis like an outer surface of the shorter side. However, the inner surface of the shorter side may be concave toward or parallel with the tube axis as will be described in embodiments.

As shown in table 1, the shorter side is thicker than the diagonal side by 1.0 mm~1.5 mm and is about 2.63 mm~4.65 mm thick. Accordingly, it is possible to form the outer surface of the shorter side to protrude toward the tube axis even though the inner surface of the shorter side is not formed to protrude to the tube axis as the outer surface of the shorter side.

Figure 1:
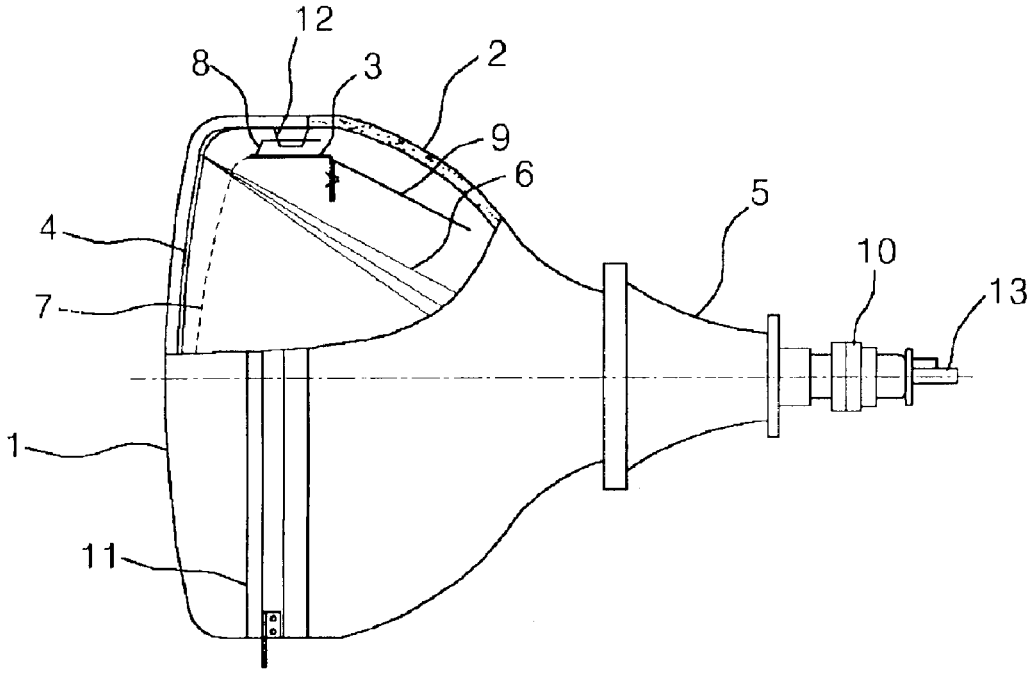
FIG. 1 (Background Art)
FIG. 1 illustrates configuration of flat color cathode ray tube according to the related art.
Figure 2:
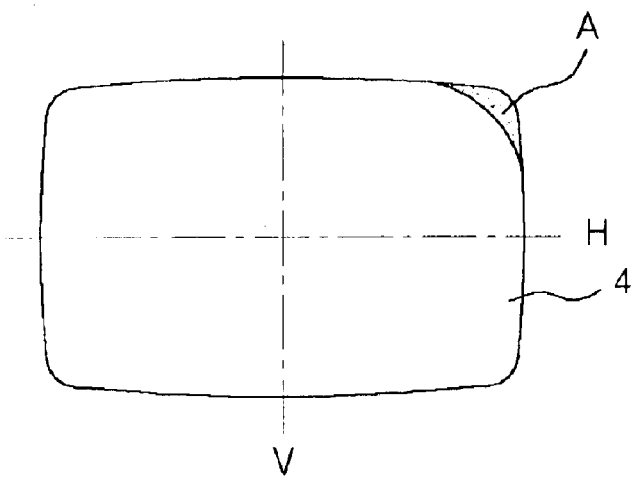
FIG. 2 (Background Art)
FIG. 2 illustrates that electron beam deflected by a deflection yoke collides an inner wall near to a neck of a funnel not to reach a fluorescent screen.
Figure 3:
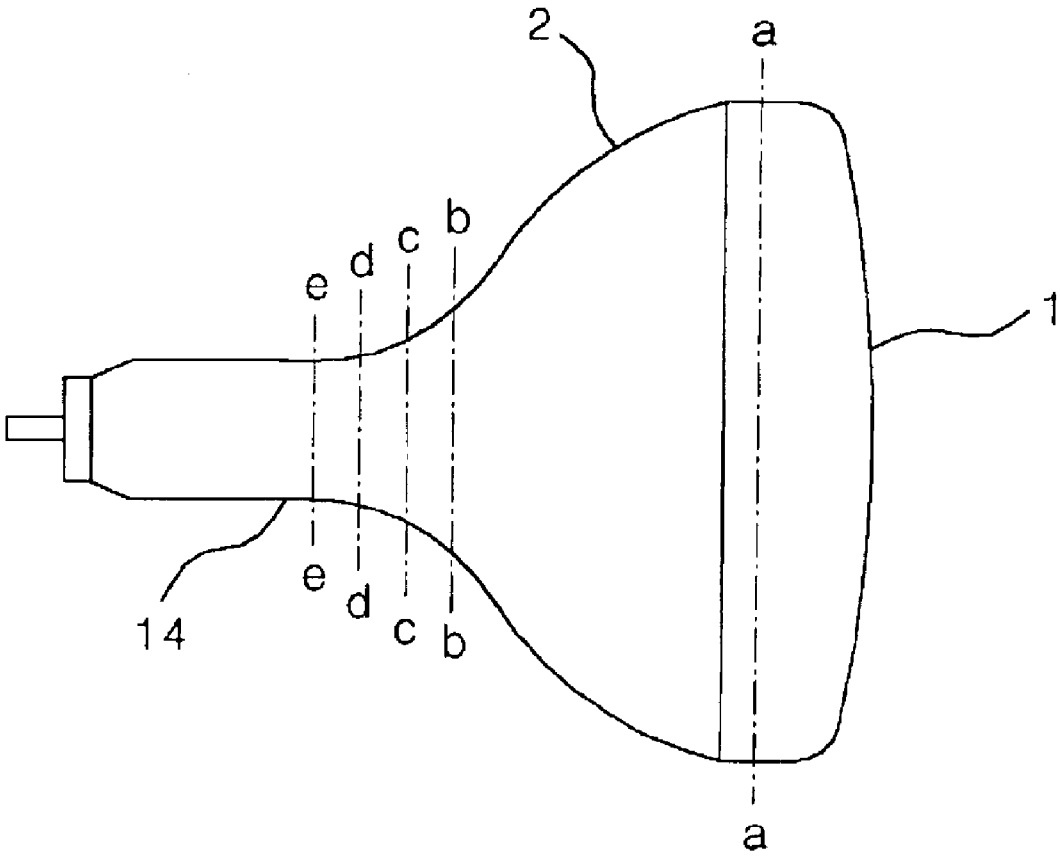
FIG. 3 (Background Art)
FIG. 3 illustrates cross-section of a funnel.
Figure 4:
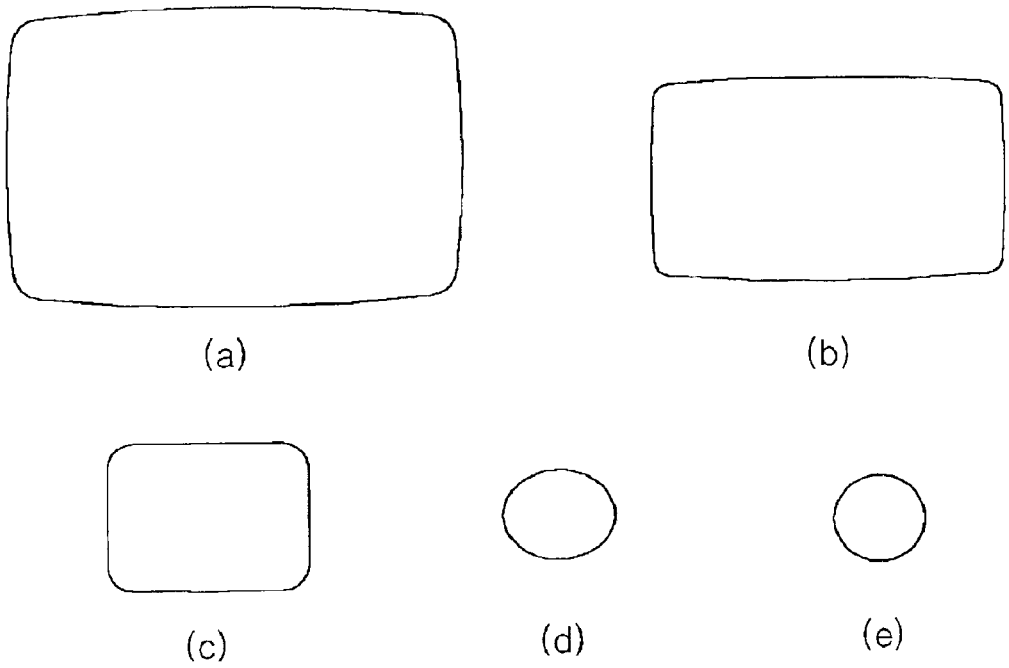
FIG. 4 (Background Art)
FIG. 4 illustrates shapes of cross-sections of a funnel.
Figure 5:
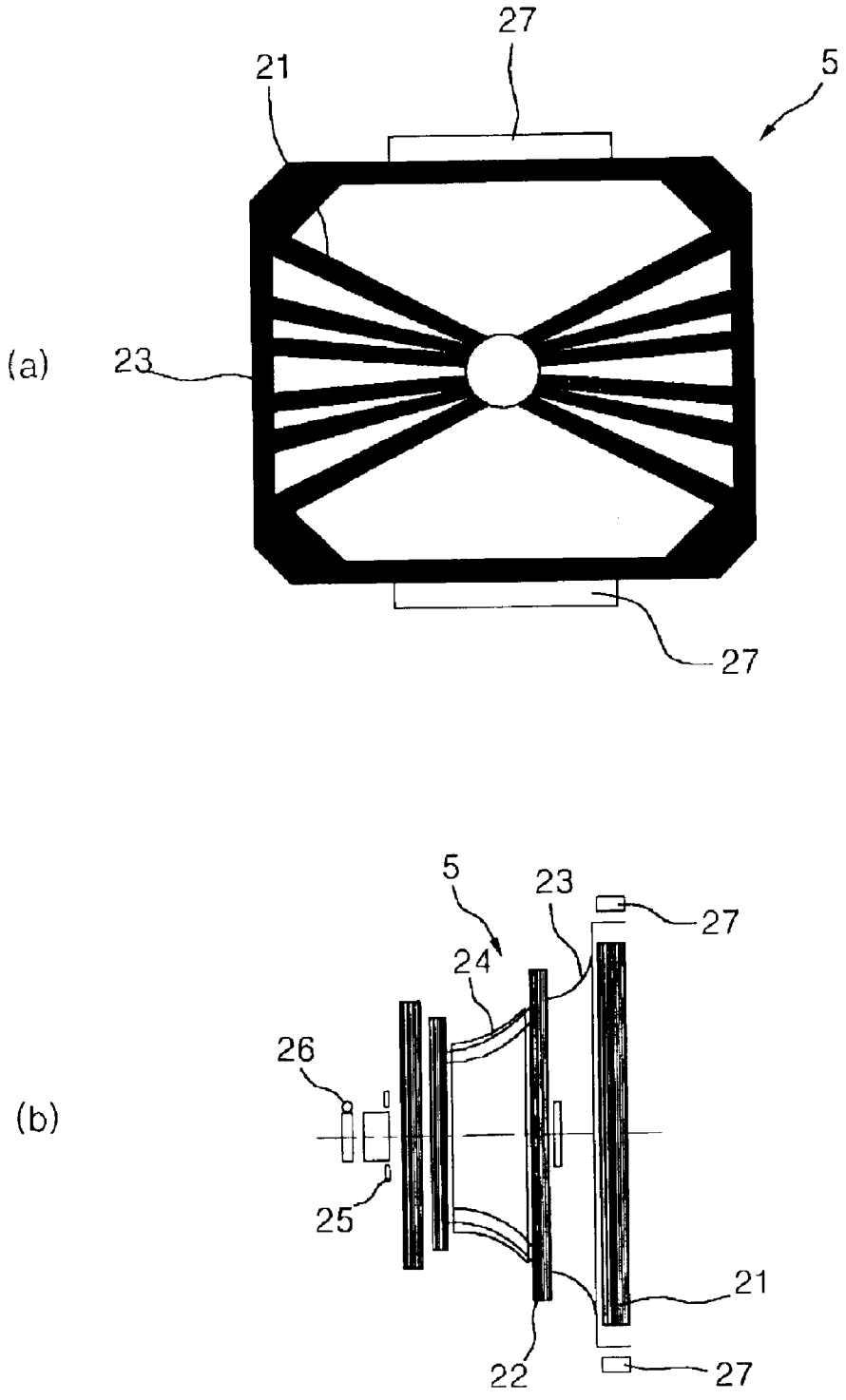
FIG. 5 (Background Art)
FIGS. 5*a* and 5*b* illustrate a deflection yoke the cross-section of which is rectangular.

In addition, as shown in FIG. 5*a*, since the shorter side of the deflection yoke 5 with the horizontal deflection coil 21 is protruded compared with the longer side without the horizontal deflection coil 21 between the end portion of the funnel of the deflection yoke 5 and the neck sealing portion of the funnel, the foregoing protruded portion toward the tube axis of the outer surface of the shorter side is preferably restricted from an end of the panel side of the deflection yoke 5 to the neck sealing portion of the funnel.

More strictly speaking, it is desired that the protruded portion of the outer surface of the shorter side of the cross-section perpendicular to the tube axis of the yoke installation part be formed between a reference line (RL) and a junction (TOR: top of round) of the yoke installation part of the funnel and the funnel-shaped funnel.

In other words, as shown in Table 1, the funnel is thin and a horizontal deflection coil is distributed entirely between the reference line pointing to a deflection center nearly and a neck sealing portion of the funnel. So, it is desired that the protruded portion be formed between the reference line (RL) and the junction portion (TOR: top of round) of the yoke installation part of the funnel and the funnel-shaped funnel.

In addition, Rzs depicted in the accompanied drawings is a mean curvature radius (Rzs) in a horizontal direction of the outer surface of the shorter side of the cross-section perpendicular to the tube axis of the yoke installation part.

The outer surface of the shorter side of the cross-section perpendicular to the tube axis of the yoke installation part is protruded to the tube axis. If the mean curvature radius in the horizontal direction is Rzs, it is desired that the mean curvature radius (Rzs) is 100 mm or more.

When the mean curvature radius (Rzs) is less than 100 mm, stress acts on too strongly.

When the mean curvature radius (Rzs) has a range of 110 mm Rzs 130 mm, the concentration of the stress is prevented and it is more desired to remove BSN phenomenon and to insert a supporting member.

Figure 9A:
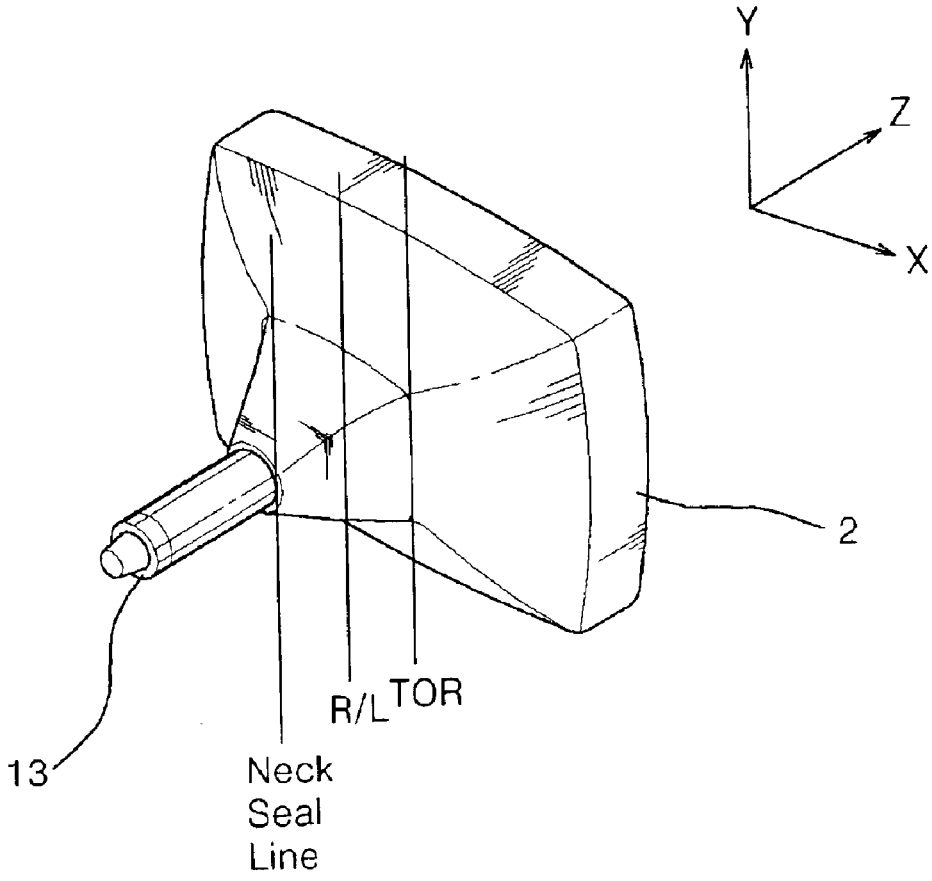
FIG. 9*a* illustrates a neck and a yoke installation part of a funnel for a cathode ray tube according to the present invention.

FIG. 9*a* illustrates a neck and a yoke installation part of a funnel for a cathode ray tube according to the present invention.

Referring to FIG. 9*a*, the yoke installation part is coupled with the neck at which an electron gun 13 is installed at the neck seal line (NSL) and coupled with a funnel-shaped funnel 2 at the TOR (top of round).

RL is a reference line used to control YPB and points to the deflection center substantially.

The yoke installation part has a different curvature radius at the NSL, RL and TOR. Especially, the curvature of the outer surface of the shorter side of the cross-section perpendicular to the tube axis of the yoke installation part and the curvature of the outer surface of the longer side affect on a sealing adhesion between the yoke installation part and the deflection yoke.

Figure 9B:
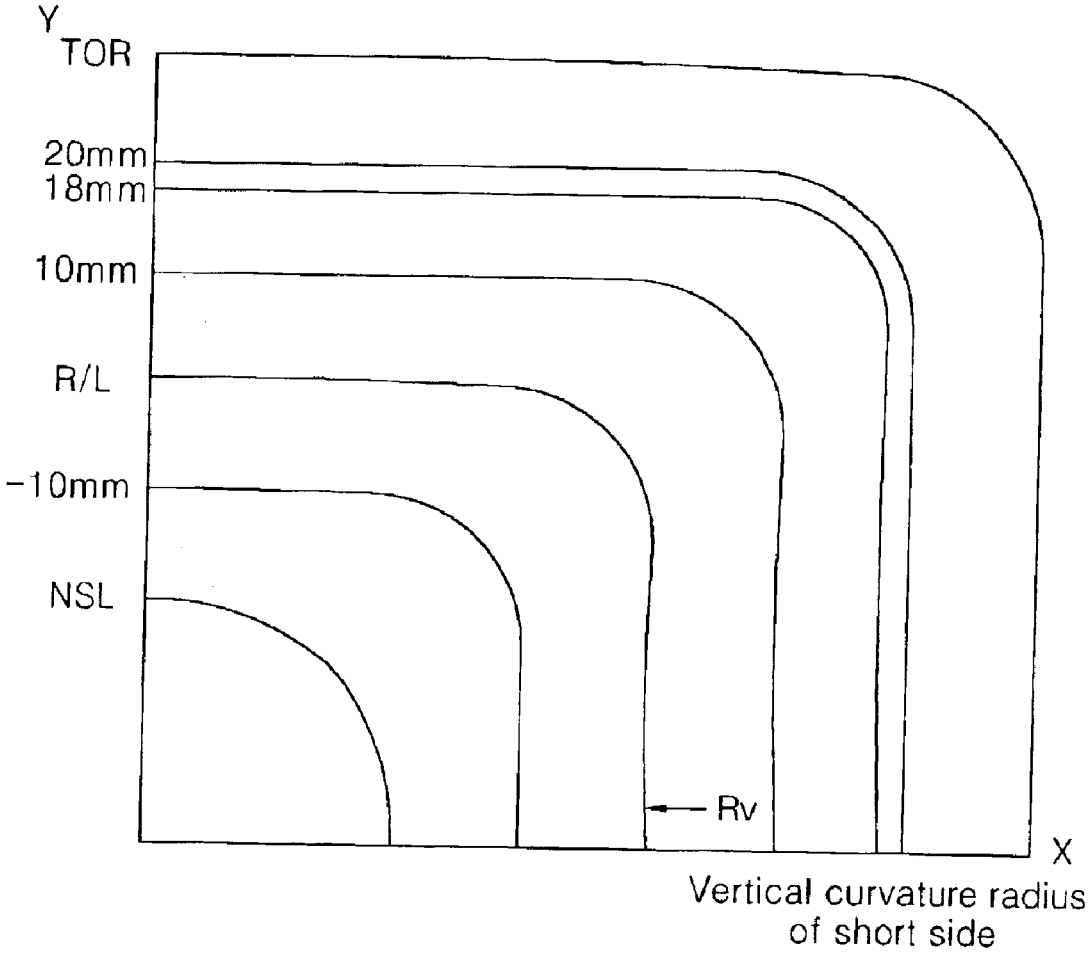
FIG. 9*b* illustrates a curvature radius of cross-section of a yoke installation part of a funnel for a cathode ray tube according to the present invention.

FIG. 9*b* illustrates a curvature radius of cross-section of a yoke installation part of a funnel for a cathode ray tube according to the present invention.

Referring to FIGS. 9*a* and 9*b*, if the outer surface of the shorter side of the cross-section perpendicular to the tube axis of the yoke installation part is convex toward the tube axis and the curvature radius in a vertical direction is Rv, it is desired that the maximal vertical curvature radius (Rv) is 1900 mm or less.

If the outer surface of the cross-section perpendicular to the tube axis of the yoke installation part is convex toward the tube axis and the curvature radius in a vertical direction is Rv, it is desired that the minimal vertical curvature radius (Rv) is 30 mm or more.

When the minimal vertical curvature radius (Rv) is less than 30 mm, the stress acts on too strongly. When the maximal vertical curvature radius (Rv) is more than 1900 mm, it is not easy to insert a support material such as a ferrite sheet so that the sealing adhesion between the yoke installation part and the deflection yoke is reduced.

FIG. 10*a* illustrates a deflection yoke coupled with a longer side of a funnel for a cathode ray tube according to the present invention and FIG. 10*b* illustrates a deflection yoke coupled with a shorter side of a funnel for a cathode ray tube according to the present invention.

Figure 6:
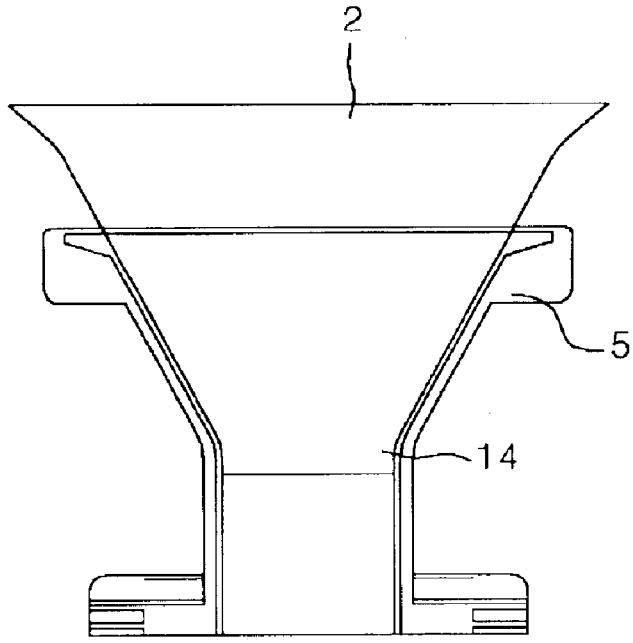
FIG. 6 (Background Art)
FIGS. 6*a* and 6*b* illustrates combination of a funnel and a deflection yoke the cross-section of which is rectangle-shaped.
Figure 6:
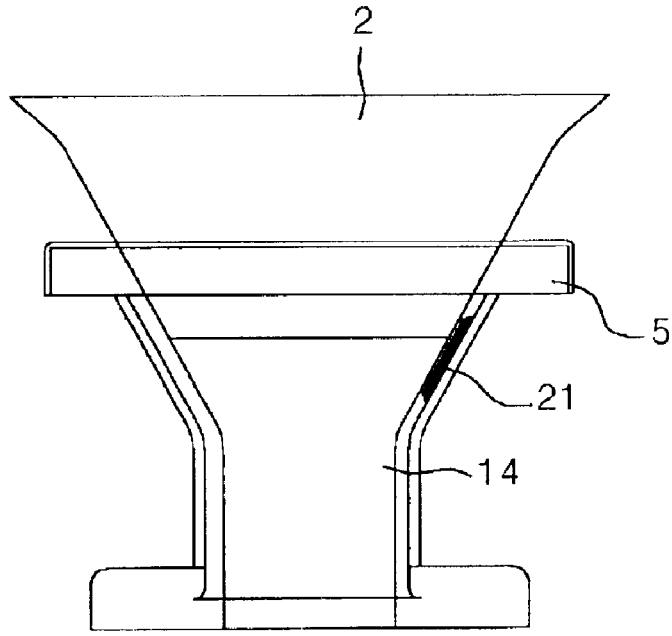
FIG. 6 (Background Art)
Figure 7:
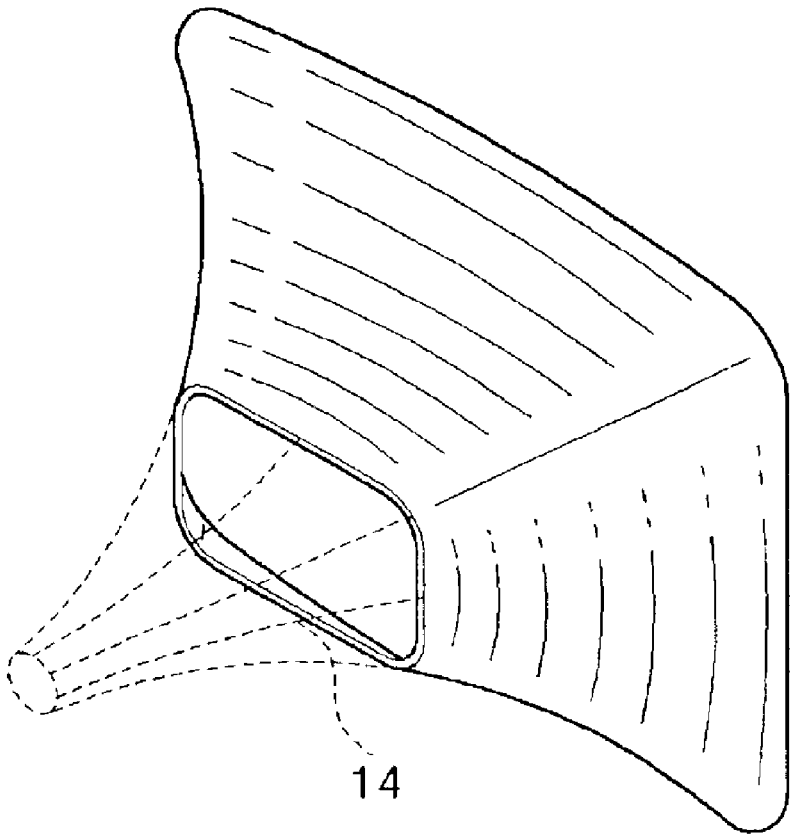
FIG. 7 (Background Art)
FIG. 7 is a perspective view of a yoke installation part coupled with a deflection yoke the cross-section of which is rectangular-shaped according to the related art.
Figure 10:
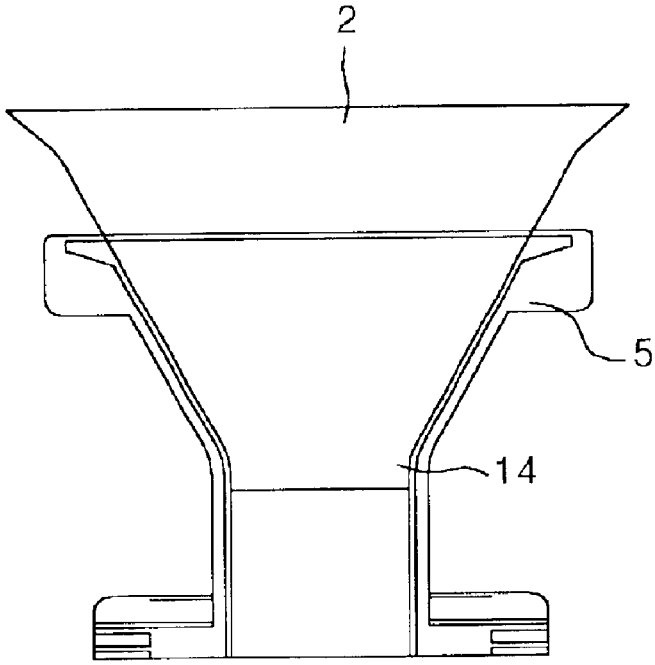
FIG. 10*a* illustrates a deflection yoke coupled with a longer side of a funnel for a cathode ray tube according to the present invention.
FIG. 10*b* illustrates a deflection yoke coupled with a shorter side of a funnel for a cathode ray tube according to the present invention.
Figure 10:
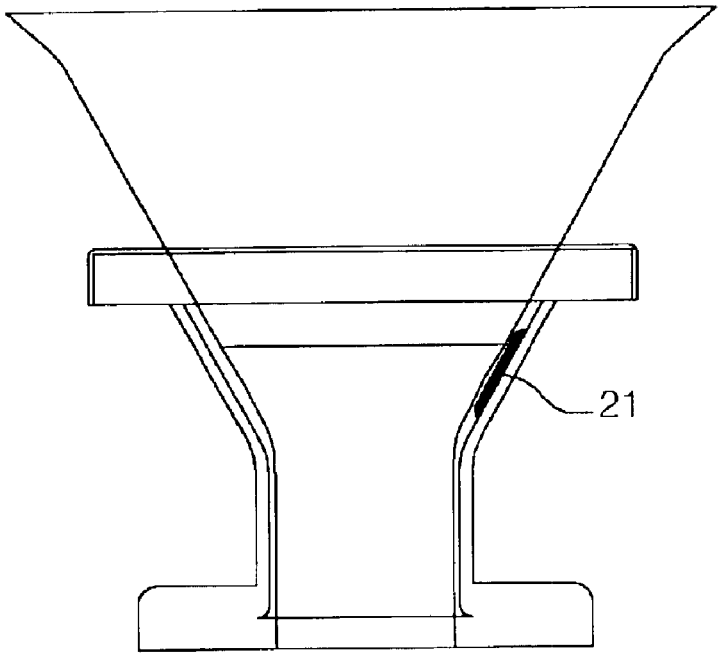

Comparing FIG. 10 with FIG. 6*b*, as the outer surface of the cross-section perpendicular to the tube axis of the yoke installation part is convex toward the tube axis, a space is formed in which a ferrite sheet adhered to an upper portion of the horizontal deflection coil 21 can be formed.

Accordingly, on the contrary to as shown in FIG. 6*b*, the sealing adhesion between the deflection yoke 5 and the yoke installation part 14 is increased and the BNS neck shadow margin is improved to prevent the electron beam from colliding the yoke installation part 14 even though the deflection yoke 5 is shifted to the neck.

FIGS. 11*a* through 11*f* illustrate an embodiment of the present invention.

Figure 11:
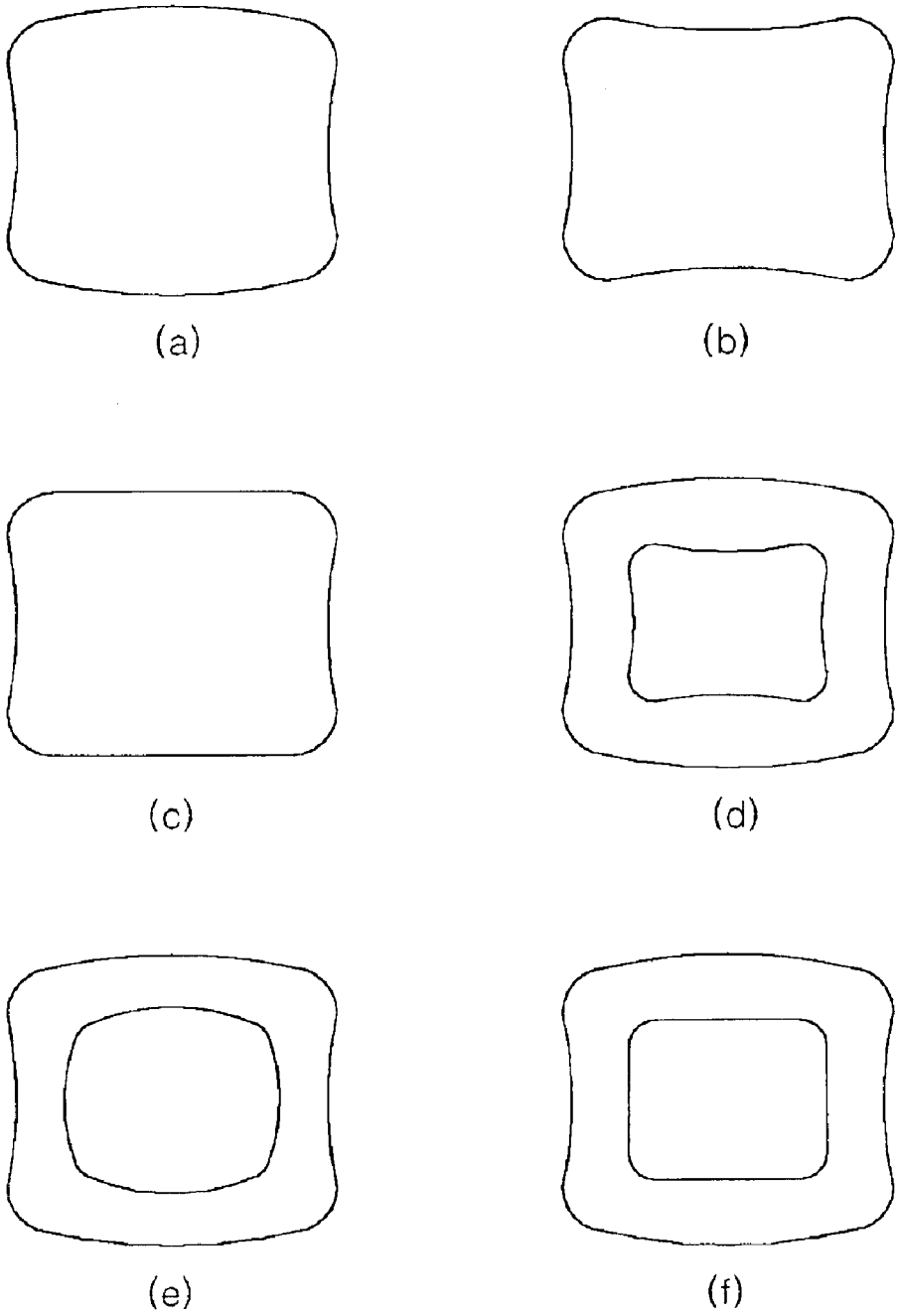
FIGS. 11*a* through 11*f* illustrate an embodiment of the present invention.

FIGS. 11*a*, 11*b* and 11*c* illustrate a cross-section of an outer surface of a cross-section perpendicular to a tube axis in a yoke installation part of a funnel. Referring to FIG. 11*a*, the outer surface of a shorter side of the cross-section perpendicular to the tube axis of the yoke installation part is formed to be convex toward the tube axis and an outer surface of a longer side is formed to be concave toward the tube axis.

Referring to FIG. 11*b*, the outer surface of a shorter side of the cross-section perpendicular to the tube axis of the yoke installation part is formed to be convex toward the tube axis and the outer surface of the longer side is formed to be convex toward the tube axis.

Referring to FIG. 11*c*, the outer surface of a shorter side of the cross-section perpendicular to the tube axis of the yoke installation part is formed to be convex toward the tube axis and two facing outer surfaces of the longer side are formed to be parallel with each other.

FIGS. 11*d*, 11*e* and 11*f* illustrate cross-sections of an inner surface and an outer surface of a cross-section perpendicular to a tube axis in a yoke installation part of a funnel. Referring to FIG. 11*d*, the outer surface of the shorter side of the cross-section perpendicular to the tube axis of the yoke installation part is formed to be convex toward the tube axis and the outer surface of the longer side is formed to be convex toward the tube axis.

Referring to FIG. 11*e*, the outer surface of the shorter side of the cross-section perpendicular to the tube axis of the yoke installation part is formed convex toward the tube axis and the outer surface of the longer side is formed to be concave toward the tube axis. The shorter side and the longer side of the inner surface are formed concave toward the tube axis.

Referring to FIG. 11*f*, the outer surface of the shorter side of the cross-section perpendicular to the tube axis of the yoke installation part is formed convex toward the tube axis. The outer surfaces of the longer side are formed concave toward the tube axis, and the longer side and the shorter side facing with each other of inner surface are formed parallel with each other.

As described above, in the funnel for a cathode ray tube according to the present invention, the outer surface of the shorter side of the cross-section perpendicular to the tube axis in the yoke installation part of the funnel is convex toward the tube axis and the maximal protruded distance is 1.5 mm or less.

The present invention is not restricted to the embodiment. For example, in a yoke installation part of a funnel, an outer surface of a shorter side of a cross-section perpendicular to a tube axis is convex toward the tube axis. The modification of the shapes of the inner surface of the shorter side, the outer surface of the longer side and the inner surface of the longer side falls within the scope of the appended claims and their equivalents.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A cathode ray tube comprising:

a panel being a front glass;

a funnel coupled with the panel to maintain vacuum inside;

a fluorescent screen formed inside the panel;

a shadow mask spaced by a predetermined gap from the fluorescent screen, for selecting colors;

an electron gun installed at a neck of the funnel; and a deflection yoke for deflecting an electron beam emitted from the electron gun in horizontal and vertical directions, wherein the funnel at which the deflection yoke is installed is provided with a yoke installation part, and an outer surface of a shorter side of a cross-section perpendicular to a tube axis of the yoke installation part is protruded toward the tube axis, and has a maximal protruded distance of 1.5 mm or less.

2. The cathode ray tube according to claim 1, wherein the maximal protruded distance ranges from 0.3 mm to 1.0 mm.

3. The cathode ray tube according to claim 1, wherein an inner surface of a longer side of the cross-section perpendicular to the tube axis of the yoke installation part is concave toward the tube axis.

4. The cathode ray tube according to claim 1, wherein two facing inner surfaces of a longer side of the cross-section perpendicular to the tube axis of the yoke installation part are parallel with each other.

5. The cathode ray tube according to claim 1, wherein an inner surface of the shorter side of the cross-section perpendicular to the tube axis of the yoke installation part is convex toward the tube axis.

6. The cathode ray tube according to claim 1, wherein an inner surface of the shorter side of the cross-section perpendicular to the tube axis of the yoke installation part is concave toward the tube axis.

7. The cathode ray tube according to claim 1, wherein curves of two facing inner surfaces of the shorter side of the cross-section perpendicular to the tube axis of the yoke installation part are parallel with each other.

8. The cathode ray tube according to claim 1, wherein an inner surface of a longer side of the cross-section perpendicular to the tube axis of the yoke installation part is convex toward the tube axis.

9. The cathode ray tube according to claim 1, wherein an outer surface of a longer side of the cross-section perpendicular to the tube axis of the yoke installation part is concave toward the tube axis.

10. The cathode ray tube according to claim 1, wherein an outer surface of a longer side of the cross-section perpendicular to the tube axis of the yoke installation part is convex toward the tube axis.

11. The cathode ray tube according to claim 1, wherein two facing outer surfaces of the longer side of the cross-section perpendicular to the tube axis of the yoke installation part are parallel with each other.

12. The cathode ray tube according to claim 1, wherein an inner surface of the cross-section perpendicular to the tube axis of the yoke installation part is concave toward the tube axis.

13. The cathode ray tube according to claim 1, wherein an inner surface of the cross-section perpendicular to the tube axis of the yoke installation part are convex toward the tube axis.

14. The cathode ray tube according to claim 1, wherein curves of facing inner surfaces of the cross-section perpendicular to the tube axis of the yoke installation part are parallel with each other.

15. A cathode ray tube comprising:

a panel being a front glass;

a funnel coupled with the panel to maintain vacuum inside;

a fluorescent screen formed inside the panel;

a shadow mask spaced by a predetermined gap from the fluorescent screen, for selecting colors;

an electron gun installed at a neck portion of the funnel; and a deflection yoke for deflecting an electron beam emitted from the electron gun in horizontal and vertical directions, wherein the funnel at which the deflection yoke is installed is provided with a yoke installation part, the funnel has a cross-section of which inner shape or outer shape vary from a circle to a non-circle as it goes from the neck to the panel, and an outer surface of a shorter side of a cross-section perpendicular to a tube axis of the yoke installation part is protruded to the tube axis and has a maximal protruded distance of 1.5 mm or less.

16. The cathode ray tube according to claim 15, wherein the maximal protruded distance ranges from 0.3 mm to 1.0 mm.

17. The cathode ray tube according to claim 15, wherein an inner surface of a longer side of the cross-section perpendicular to the tube axis of the yoke installation part is concave toward the tube axis.

18. The cathode ray tube according to claim 15, wherein two facing inner surfaces of a longer side of the cross-section perpendicular to the tube axis of the yoke installation part are parallel with each other.

19. The cathode ray tube according to claim 15, wherein an inner surface of the shorter side of the cross-section perpendicular to the tube axis of the yoke installation part is convex toward the tube axis.

20. The cathode ray tube according to claim 15, wherein an inner surface of the shorter side of the cross-section perpendicular to the tube axis of the yoke installation part is concave toward the tube axis.

21. The cathode ray tube according to claim 15, wherein curves of two facing inner surfaces of the shorter side of the cross-section perpendicular to the tube axis of the yoke installation part are parallel with each other.

22. The cathode ray tube according to claim 15, wherein an inner surface of a longer side of the cross-section perpendicular to the tube axis of the yoke installation part is convex toward the tube axis.

23. The cathode ray tube according to claim 15, wherein an outer surface of a longer side of the cross-section perpendicular to the tube axis of the yoke installation part is concave toward the tube axis.

24. The cathode ray tube according to claim 15, wherein an outer surface of a longer side of the cross-section perpendicular to the tube axis of the yoke installation part is convex toward the tube axis.

25. The cathode ray tube according to claim 15, wherein two facing outer surfaces of the longer side of the cross-section perpendicular to the tube axis of the yoke installation part are parallel with each other.

26. The cathode ray tube according to claim 15, wherein an inner surface of the cross-section perpendicular to the tube axis of the yoke installation part is concave toward the tube axis.

27. The cathode ray tube according to claim 15, wherein an inner surface of the cross-section perpendicular to the tube axis of the yoke installation part are convex toward the tube axis.

28. The cathode ray tube according to claim 15, wherein curves of facing inner surfaces of the cross-section perpendicular to the tube axis of the yoke installation part are parallel with each other.

29. The cathode ray tube according to claim 15, wherein a shape of the cross-section perpendicular to the tube axis of the yoke installation part is rectangular.

30. A cathode ray tube comprising:

a panel being a front glass;

a funnel coupled with the panel to maintain vacuum inside;

a fluorescent screen formed inside the panel;

a shadow mask spaced by a predetermined gap from the fluorescent screen, for selecting colors;

an electron gun installed at a neck portion of the funnel; and a deflection yoke for deflecting an electron beam emitted from the electron gun in horizontal and vertical directions, wherein the funnel at which the deflection yoke is installed is provided with a yoke installation part, and an outer surface of a shorter side of a cross-section perpendicular to a tube axis of the yoke installation part forms a curvature protruded toward the tube axis and has a maximal vertical curvature radius (Rv) of 1900 mm or less.

31. The cathode ray tube according to claim 30, wherein an outer surface of a shorter side of cross-section perpendicular to a tube axis of the yoke installation part forms a curvature protruded toward the tube axis, and a protruded portion toward the tube axis is formed between a reference line (RL) and a junction portion (TOR: Top of Round) of a yoke installation part of a funnel and a funnel-shaped funnel.

32. The cathode ray tube according to claim 30, wherein an outer surface of a shorter side of cross-section perpendicular to a tube axis of the yoke installation part forms a curvature protruded toward the tube axis and has a minimal vertical curvature radius (Rv) in the vertical direction of 30 mm or more.

33. The cathode ray tube according to claim 30, wherein an outer surface of a shorter side of cross-section perpendicular to a tube axis of the yoke installation part forms a curvature protruded toward the tube axis and has a mean curvature radius (Rzs) in the horizontal direction of 100 mm or more.

34. The cathode ray tube according to claim 33, wherein an outer surface of a longer side of cross-section perpendicular to a tube axis of the yoke installation part forms a curvature protruded toward the tube axis and has a mean curvature radius (Rzs) in the horizontal direction of 110 mm to 130 mm.

* * * * *